US006329098B1

(12) United States Patent
Bliesner

(10) Patent No.: US 6,329,098 B1
(45) Date of Patent: Dec. 11, 2001

(54) METHOD FOR CONVERTING AND STORING ENERGY

(76) Inventor: Wayne Thomas Bliesner, 22521 138 Ave. SE., Snohomish, WA (US) 98296

( * ) Notice: Subject to any disclaimer, the term of this patent is extended or adjusted under 35 U.S.C. 154(b) by 0 days.

(21) Appl. No.: 09/620,537

(22) Filed: Jul. 23, 2000

Related U.S. Application Data

(62) Division of application No. 08/977,385, filed on Nov. 24, 1997, now Pat. No. 6,093,504.

(51) Int. Cl.[7] ..... H01M 6/20
(52) U.S. Cl. ..... 429/103
(58) Field of Search ..... 204/241, 242, 204/243.1, 254, 255, 268, 269; 429/103, 104, 16, 17, 21; 136/201, 203, 200, 242

(56) References Cited

U.S. PATENT DOCUMENTS

| | | | | |
|---|---|---|---|---|
| 3,468,786 | * | 9/1969 | Day | 204/243 |
| 3,649,480 | * | 3/1972 | Johnson | 204/67 |
| 3,674,567 | * | 7/1972 | Bradley et al. | 204/129 |
| 3,994,745 | * | 11/1976 | Ludwig | 429/81 |
| 4,011,148 | * | 3/1977 | Goudal | 136/201 |
| 4,269,907 | * | 5/1981 | Momyer et al. | 429/149 |
| 4,284,838 | * | 8/1981 | Indech | 136/202 |
| 4,287,045 | * | 9/1981 | Lechevaillier et al. | 204/243 R |
| 4,421,833 | * | 12/1983 | Zayatz et al. | 429/149 |
| 4,546,056 | * | 10/1985 | Jessen et al. | 429/149 |
| 4,755,350 | * | 7/1988 | Kennel | 136/202 |
| 4,833,046 | * | 5/1989 | Roy | 429/103 |
| 5,039,351 | * | 8/1991 | Cooper et al. | 136/200 |
| 5,225,295 | * | 7/1993 | Lim et al. | 429/149 |

* cited by examiner

*Primary Examiner*—Bruce F. Bell
*Assistant Examiner*—Thomas H Parsons
(74) *Attorney, Agent, or Firm*—Dowrey & Associates

(57) ABSTRACT

A method of converting and storing energy in a repeatable cycle using a rechargeable electrolytic cell providing a thermal energy output during discharge, and which recharges electrically. The cell contains chemical reactants and reactant product. The reactant product is electrolyzed into the reactants by at least one electrode in operational communication with the reactant product. The electrode has a porous portion, and one of the reactants, the oxidizer, is conveyed through the porous portion of the electrode, without conveying the reactant product through it, into a hollow internal cavity in the electrode. The reactants are separated and stored in the cell. The stored reactants are controllably combined to produce the reactant product and the thermal energy output. The thermal energy is removed from the cell for useful purposes.

13 Claims, 3 Drawing Sheets

30
14
31
13
56
35
55
32
16
34
33
11
17
1
27
5
6
7
18
36
46
20
8
19
72
62
51
50
72
15
21
4
39
25
24
47
10
49
53
48
28
3
9
23
29
12
2
22
52
54
26

METHOD FOR CONVERTING AND STORING ENERGY

CROSS-REFERENCE TO RELATED APPLICATIONS

This application is a divisional application of application Ser. No. 08/977,385 filed on Nov. 24, 1997 (now U.S. Pat. No. 6,093,504), and claims the benefit, under 35 U.S.C. 120 of it.

STATEMENT REGARDING FEDERALLY SPONSORED RESEARCH OR DEVELOPMENT

Not applicable.

REFERENCE TO A MICROFICHE APPENDIX, IF ANY

Not Applicable.

BACKGROUND OF THE INVENTION

1. Field of the Invention

This invention relates to rechargeable stored energy systems, specifically to:

a Improvements in specific energy density for a reversible cell.

b Improvements in specific power density delivered from a reversible cell.

c Improvements in cell cost for a given energy density.

2. Background Information

A detailed patent search was carried out covering over 500 individual patent searches including cross references. The research found electrically charged battery systems with electrical output. Their was no mention of an electrically rechargeable system with a thermal discharge output in combination.

Search categories included: 429.149, 136.200, 136.202, 429, 429.17, 204.248, 429.19, 429.247, 136.224, 320, 431.80, 432.30, 429.12, 136.203.

The systems were either pure electric, i.e. charge and discharge, or pure thermal. There was mention of systems which started with heat and converted it to electricity.

The current invention provides a unique combination of electrical charging with a thermal discharge. The system is a fully reversible closed system.

BRIEF SUMMARY OF THE INVENTION

The electro-chemical-thermal cell is a unique combination which has significant advantages in terms of energy and power density over existing electrical or thermal storage cells. The system charges electrically storing the bulk of the energy in chemical form. This allows indefinite storage capabilities with full power on restart. The thermal output design focuses the heat into a small high temperature region. This provides the maximum efficiency to thermal power conversion systems such as Stirling, Brayton, or Rankine cycles.

The ECT cell is unique in the use of a salt control valve which maintains a local low temperature eutectic salt mixture around the electrodes. This allows higher energy densities in the cell by reducing the quantities of eutectic salts. The valve functions by regulating a dry powdered Sodium Chloride into the eutectic bath at a rate determined by the electrolysis of the Sodium Chloride in the eutectic bath.

The ECT cell is also unique in its ability to operate as a single cell independent of the number of electrodes used. A technique is used to electrically isolate each electrode within the salt bath so as to prevent shorting from the liquid metal formed during electrolysis.

The ECT cell is also unique in the use of a Boron Carbide 'valve electrode' layer made from a porous graphite starting material.

DETAILED DESCRIPTION

General Arrangement

Figure 1:
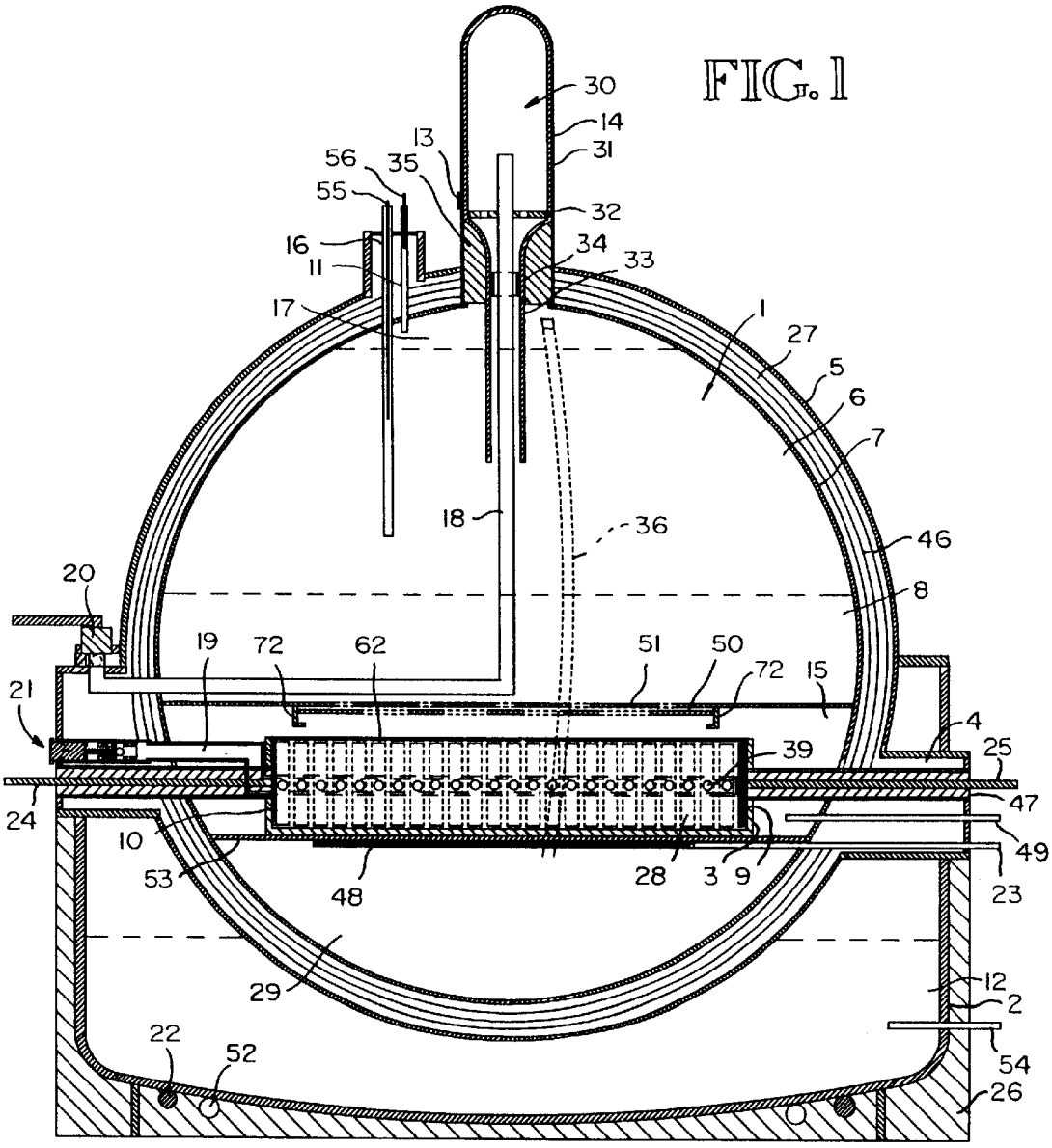
FIG. 1 shows a vertical cross-sectional view of the complete battery system. The system includes the main cell, an oxidizer tank, two valves and connecting lines. Details of the electrode assembly and a typical electrode are shown in FIGS. 2 and 3, respectively. The main cell is surrounded by a thermal cover; a vacuum liner with a multi-foil reflective liner as shown in FIG. 1. Working fluid levels are shown by dashed lines in the two containers.

FIG. 1 shows the complete electro-chemical-thermal cell system in vertical cross-section view. The ECT cell consists of a main cell 1 and an oxidizer tank 2. The main cell 1 contains both the charge and discharge sections of the cell. A reaction chamber 30 is located at the top of the main cell 1. A set of electrodes 28, for recharging, are located in the lower center of the main cell 1. All of the fuel, Sodium metal, is stored in the main cell 1 above the reacted salt in a Sodium region 6.

The main cell 1 contains a Sodium Chloride region 8 which is shown in the middle of the cell as a dry powder. The salt is a chemical compound consisting of a metal, preferably a light metal, and a non-metal, preferably a strong oxidizer. A quantity of metal is shown floating on the Sodium Chloride region 8 in the Sodium region 6. The level of the metal/salt interface depends on the level of charge in the system. An Argon gas region 17 is shown above the Sodium region 6. The interface between the metal and inert gas also moves up and down depending on the level of charge in the system. The lower region of the main cell 1 contains the set of electrodes 28 and a low melting point liquid salt mixture 15. The lower region has a Sodium Chloride Holder Plate 51 which separates the powdered Sodium Chloride Region 8 above the plate and the Sodium Chloride, Calcium Chloride, and Barium Chloride salt mixture 15 below the plate. An Insulator Float Plate 50 floats on the liquid salt mixture 15, during charging, and acts as a valve controlling the amount of Sodium Chloride allowed into the lower salt mixture.

In the charge cycle, one of the oxidizer components, Chlorine, is separated from the salt during electrolysis and is ducted into the oxidizer tank 2 where it combines with the Iodine to form Iodine Chloride and Iodine TriChloride. An oxidizer recharge valve 21 is used to control the flow from the electrodes 28 to the oxidizer tank 2.

An oxidizer flow valve 20 is used to control the flow of oxidizer from the oxidizer tank 2 to the reaction chamber 30 during cell discharge.

The main cell 1 is surrounded by an evacuated thermal cover. The thermal cover is made of multilayer sheeting, such as a thin reflective foil 46, spaced inside an evacuated region 27.

The Main Cell

The main cell 1 is shown, in FIG. 1, with a 430 Stainless Steel shell for a main cell inner container 7 surrounding the working fluids. The container is coated on the inside with an electrically insulating ceramic which is also non-wetting and chemically inert relative to the salts and liquid metal. The ceramic coating consists of first a layer of Chromium Carbide applied over the Stainless Steel surface, then a layer of Boron Nitride. A Main Cell Outer Container 5 is also made from the 430 Stainless Steel. The outer shell is thicker to prevent buckling of the container due to the pressure differential caused by the vacuum. The outer container 5 has a set of evacuated couplings 4 located where tubes or electrodes connect across the inner and outer container wall. The extensions reduce the conduction losses for each coupling by providing a longer connector path inside the evacuated region 27.

An electrode housing 3 is a structural container which holds the electrodes 28 in place. The electrode housing 3 is also made of 430 Stainless Steel and is coated both inside and outside with Chromium Carbide and Boron nitride. The electrodes 28 are fitted between the electrode housing 3 walls and held in place with a set of ceramic spacers 37 shown in FIG. 2.

A left electrode feed line 24, shown in FIG. 1, is attached to a left Molybdenum end plate 10. A right electrode feed line 25 is attached to a right Molybdenum end plate 9. The current design uses Molybdenum for the two electrode feed lines 24 and 25 due to its corrosion compatibility with the working fluids. The two electrode feed lines 24 and 25 are insulated from each other, inside of the main cell 1, by a ceramic insulation 47. The Molybdenum end plates 9,10 are attached so as to provide an electrically conducting current path through the electrodes 28 and the salt mixture 15.

Figure 4A:
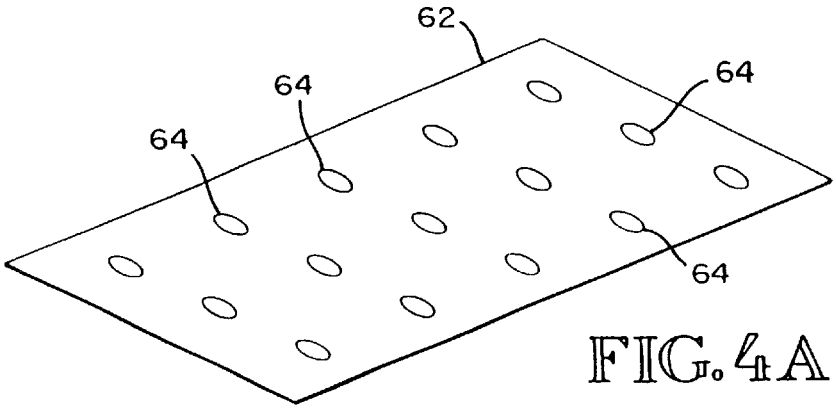
FIG. 4A is a perspective view of a reactant dispenser.

Referring also to FIG. 4A, the electrode housing 3 has a set of tailored holes 64 located in the top 62 of the housing which allow the liquid Sodium to float up out of the box through the liquid salt mixture 15. The tailored holes 64 allow the Sodium to escape from each electrode 28 as individual droplets which rise through the liquid salt mixture 15 preventing electrical shorting between electrodes 28.

Figure 4B:
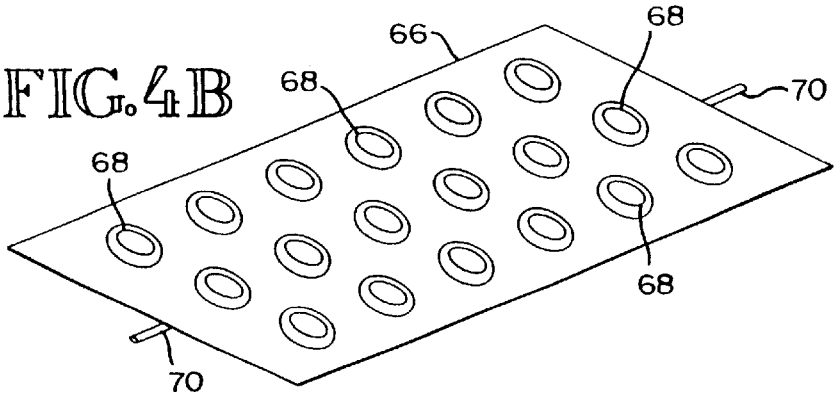
FIG. 4B is another embodiment of a reactant dispenser.

Referring to FIG. 4B, in and alternate embodiment, electrode housing 3 has a movable cover 66 located above the electrodes. Cover 66 has a set of individual pockets 68, one above each electrode, which allow the liquid metal to collect and be electrically isolated after leaving the electrodes. The cover 66 is huge so that after a quantity of liquid metal has collected in the individual pockets 68, the buoyancy forces caused the cover 66 to pivotally rotate upwards about pivot 70, thereby releasing the metal accumulated in the pockets 68. Preferably, the cover 66 is electrically connected with the electrodes so that the electrodes are energized when the cover 66 is down, and when the cover rotates upward the electric circuit is interrupted to deenergize the electrodes until it rotates back down into position.

The electrodes 28 have an oxidizer outlet 39 which connects the electrodes 28 to an oxidizer outlet line 19. The oxidizer outlet line 19 is connected to the oxidizer tank through the oxidizer recharge valve 21.

The main cell 1 has the reaction chamber 30 located at the center region. The reaction chamber 30 is constructed of 430 Stainless Steel and is coated with the Chromium Carbide and Boron Nitride. A heat pipe 14 is located outside of the reaction chamber 30 and transmits the generated heat. The heat pipe 14 is connected to a heat engine such as a Stirling or Brayton engine, not shown. The heat engines can be heated directly from the heat pipe 14 or a secondary heat conduit can be used to move the heat from the heat pipe 14 to the heat engine.

An oxidizer input line 18 is connected from the bottom of the reaction chamber 30 to the oxidizer flow valve 20. The bottom of the reaction chamber 30 has a Sodium inlet and Sodium Chloride outlet 33 which allows the various working materials to enter and leave. The Sodium inlet and Sodium Chloride outlet 33 consists of a carbon spacer 35 which is connected to the reaction chamber 30. The outlet also has a liquid Sodium wick 31 which starts in the Sodium region 6 and ends inside the reaction chamber 30. The outlet also has a wick spacer 34 which holds the Sodium wick 31 in position. The oxidizer input line 18 holds the inlet wick spacer in position. A wick holder 32 holds the Sodium wick 31 against the reaction chamber 30 walls. A reaction chamber temperature probe 13 is used to measure the reaction chamber 30 temperature during operation.

A fill line and temperature probe holder 16 is located in the top of the main cell 1. A Sodium temperature probe 55 is used in the main cell 1 during operation. A vent and pressure probe holder 11 is located in the top of the main cell 1. A main cell pressure probe 56 is used in the main cell 1 during operation.

A lower Argon gas region 29 is located at the bottom of the main cell 1. The lower Argon gas region 29 is attached to the Argon gas region 17 by an Argon gas line 36. The lower Argon gas region 29 is enclosed by a bottom plate 53 from the rest of the main cell 1. A salt mixture heater 48 is located on the lower side of the bottom plate 53 inside of a heater conduit 23. The heater conduit 23 is a closed tube which connects through the right evacuated coupling 4.

A salt mixture temperature probe 49 is located in the right evacuated coupling 4. The probe is located inside of the main cell inner container 7.

Oxidizer Tank

The oxidizer tank 2, shown in FIG. 1, stores an oxidizer 12 separate from the main cell 1. The tank is constructed from Stainless materials and covered with Chromium Carbide and Boron Nitride. A heater for oxidizer region 22 is attached to the bottom of the oxidizer tank 2. An oxidizer tank thermal cover 26 surrounds the oxidizer tank 2. A cooling system 52 is also attached to the bottom of the oxidizer tank 2 and is used during recharge mode. The cooling system could use water as a heat transfer source.

The oxidizer recharge valve 21 is an automatic one way flow valve which allows flow from the main cell 1 into the oxidizer tank 2 during charging. An oxidizer temperature probe 54 is located inside of the oxidizer tank 2.

Electrode Assembly Detail

Figure 2:
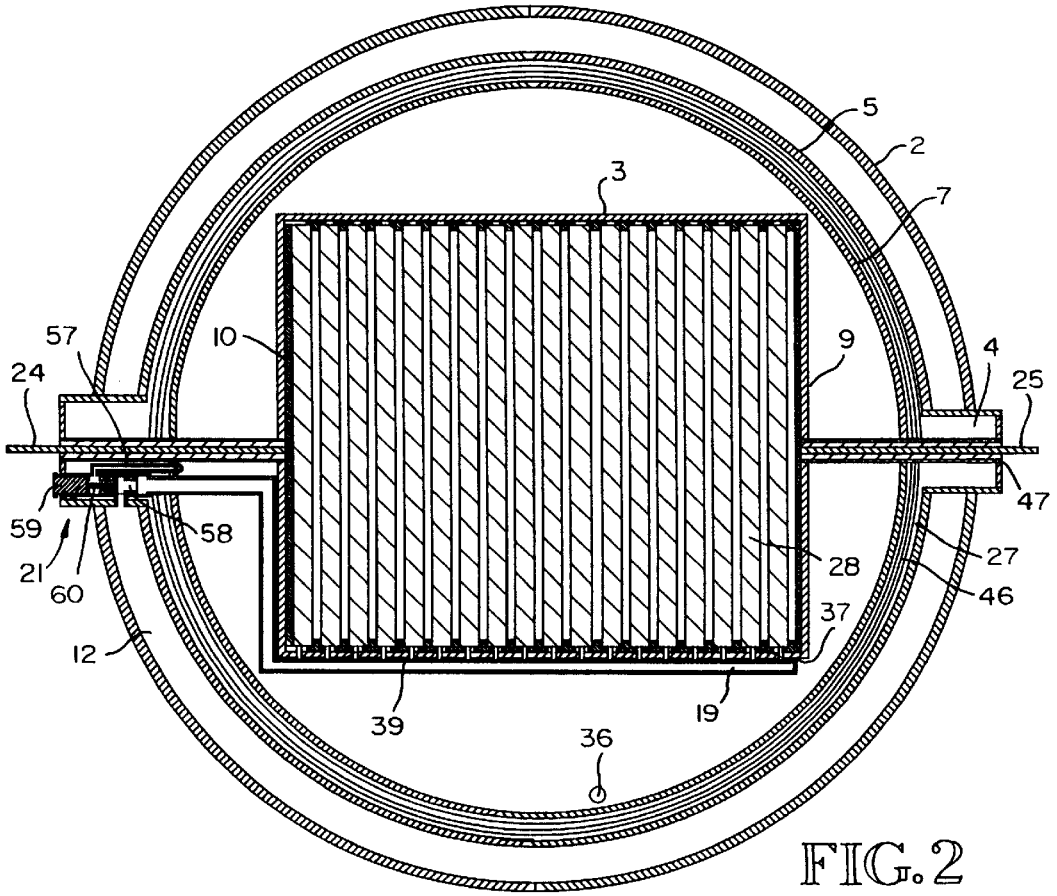
FIG. 2 is a horizontal cross-sectional view of the electrode assembly which is used for charging the system. The electrode feed lines are shown emerging from the main cell. The top of the electrodes are shown in the middle of the electrode assembly. The electrode assembly includes an electrode housing surrounding all sides of the electrodes including the top. The ceramic spacers, shown in FIG. 2, are between each electrode.

Referring to FIG. 2, the electrode housing 3 is shown surrounding the graphite electrodes 28. The electrode housing 3 is constructed of 430 Stainless Steel with a Chromium Carbide and Boron Nitride ceramic coating inside and out, chemically and electrically isolating all of the components. The Molybdenum end plates 9,10 are attached to the electrode feed lines 24, 25. The Molybdenum end plates 9,10 are covered with Hexagonal Boron Nitride on the sides which are exposed to the liquid salt. Ceramic spacers 37 are used to hold the spacing between the individual graphite electrodes 28. The oxidizer outlet 39 connects the individual graphite electrodes 28 to the oxidizer outlet line 19. The number of electrodes used is determined by the charging voltage requirements.

The oxidizer outlet line 19 is connected to the oxidizer recharge valve 21. The oxidizer recharge valve 21 is shown with an adjustable bolt 59 on the outside of the left evacuated coupling 4. The oxidizer recharge valve 21 has a spring 60 attached from the adjustable bolt 59 to a valve body 58. The valve body 58 has four O rings located at either end of the cylindrical body. A set of vent holes are located between the mid two O rings and are connected to a central hole which runs out the right side of the cylindrical body. The oxidizer recharge valve 21 vents into the oxidizer tank through a side hole which runs from the oxidizer recharge valve 21 through the evacuated coupling 4. An Argon control line 57 is mounted to the oxidizer recharge valve 21 between the adjustable bolt 59 and the valve body 58. The Argon control line 57 is also attached to the Argon region below the bottom plate 53.

Electrode Detail

Figure 3:
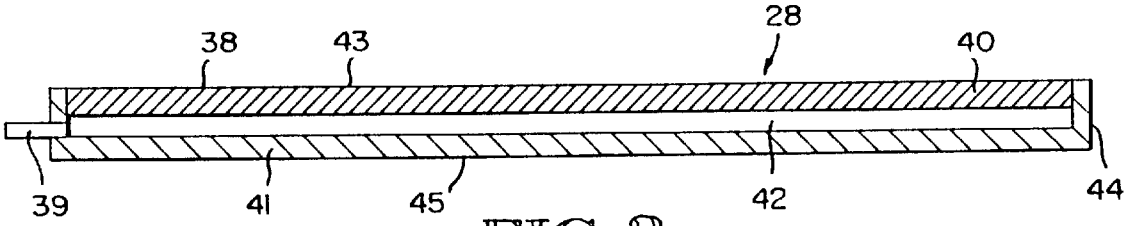
FIG. 3 is a cross sectional view of one of the electrodes. The oxidizer is ducted out of the left side of the electrode and into the oxidizer outlet line shown in FIG. 2.

FIG. 3 is a cross-sectional view of an individual graphite electrode 28. The graphite electrode 28 consists of a dense graphite 41 shell which is hollowed out and machined to have a slotted cavity 42 for the oxidizer flow. The slotted cavity 42 consists of a series of channels which run the length of the graphite electrode 28. The channels converge to the oxidizer outlet 39. A porous graphite 40 layer is fitted into the graphite electrode 28 and is coated with a ceramic layer to form the 'valve electrode' 38. A ceramic layer 43 consists of Boron Carbide which is created by infiltration of Boron atoms into the outer surface of the porous graphite 40 structure. The resulting Boron Carbide coating extends part way through the porous graphite 40 and has almost the same porosity as the original porous graphite 40. A coating of Turbostratic Boron Nitride is added over the Boron Carbide to increase the electrical resistance of the ceramic layer.

Operation

The Electro-Chemical-Thermal cell provides a significant increase in specific energy storage and specific power release rate relative to existing electrically charged/discharged cells. This is due to the thermal output design which provides approximately 4 to 10 times the energy density of electrical discharge systems for equivalent reactants. The cell has the further benefit of not producing Carbon Dioxide during operation, which is known to contribute to global warming.

System Overview

The system charges using electrical input through a series of graphite electrodes 28. The molten salt is broken into its elements using electrolysis at each graphite electrode 28. One side of the graphite electrode 28 produces the constituent metal which floats to the top of the sodium chloride region 8. The other side of the graphite electrode 28 produces the oxidizer 12 which is internally ducted into the graphite electrode 28 and out of the main cell 1 into the oxidizer tank 2. When the main cell 1 is discharged a small quantity of liquid metal remains above the salt. The excess metal provides the preheat fuel required to heat the cell to a temperature which melts both the metal and the salt, prior to charging. An alternate heating method is to use the salt mixture heater 48. When the main cell 1 is charged, a small amount of salt remains which covers the graphite electrodes 28 preventing them from electrically shorting. The use of thermal output allows the main cell 1 to be constructed as a single cell independent of size. This is due to the ability to separate the metal and oxidizer away from the graphite electrodes 28 after electrolysis.

Cell discharge occurs in the reaction chamber 30 where the output heat is generated. The reaction chamber 30 is isolated so that a high localized temperature can be maintained. The high temperature is necessary to provide an efficient operation of an external combustion engine; such as a Stirling, Brayton, or Rankine cycle engine. The external heat pipe 14 transfers the energy from the reaction chamber 30 to the engine with minimal losses. The heat transfer can be directly from the heat pipe 14 or through a heat conduit or thermosyphon located between the ECT cell and the engine. The rate of oxidizer addition to the reaction chamber 30 determines the heat flux available to the heat pipe 14. The heat output rate is significantly higher than an equivalent electrical output cell due to the ease of sizing the heat pipe 14 to significantly higher power rates.

System Charging

The system is ready for charging when the quantity of salt mixture 15 is liquefied in the main cell 1. The salt mixture temperature probe 49 measures the salt mixture temperature. The heating of the salt mixture can be accomplished electrically with the salt mixture heater 48 on the outside of the bottom plate 53. The two containers, the oxidizer tank 2 and the main cell 1, are insulated to minimize losses from the containers. The oxidizer tank 2 operates at temperatures which are significantly lower than the main cell 1. The lower temperature minimizes the heat losses from the oxidizer tank 2 allowing a fiber type insulation shown as the oxidizer tank thermal cover 26. The main cell 1 contains the majority of the working fluids at a moderately high temperature. Since heat losses through the main cell outer container 5 are the largest direct efficiency loss, it is beneficial to insulate this main cell outer container 5 using a multi-layer foil vacuum container. This allows the main cell 1 to remain hot, with the metal and salt in a molten state, for several weeks without the need to preheat the system. The vacuum container consists of the main cell inner container 7 which holds the liquid metal and salts. The region between the inner and outer containers 5 and 7 contains the evacuated region 27. A multi-layer set of thin metal reflective foil 46 is used to improve the insulation.

Once the system is up to temperature a pressure differential is created between the main cell 1 and the oxidizer tank 2. The oxidizer tank 2 pressure is reduced by the amount tolerated by the 'valve electrode'. The pressure can be reduced in the oxidizer tank 2 by reducing the temperature of the oxidizer tank by using the cooling system 52. The oxidizer recharge valve 21 is set to the desired pressure difference between the main cell and the oxidizer tank, which is approximately 1 to 2 pounds per square inch pressure. Once the system starts charging, the pressure differential will be maintained by the cooling rate of the oxidizer in the oxidizer tank 2. Oxidizer recharge valve 21 is allowed to move oxidizer from the graphite electrodes 28 to the oxidizer tank 2.

Oxidizer recharge valve 21 is an automatic one-way valve which opens when the pressure in the main cell 1 is above the oxidizer tank 2 pressure. The oxidizer recharge valve 21 operates using the Argon pressure as a reference pressure source. The Argon control line 57 is located on one side of the valve body 58. The spring 60 is tied between the valve body 58 and the adjustable bolt 59. The spring 60 provides the pressure differential capability by applying a pulling force to the valve body 58. When the pressure differential is within 0 to 2 psi, the valve body 58 allows oxidizer 12 flow from the electrodes 28 to the oxidizer tank 2. At higher and lower pressures the valve body 58 seats at a left or right position and closes off the oxidizer flow.

The higher pressure forces the oxidizer into the oxidizer tank 2 where the cooling system 52 cools the mixture and lowers the vapor pressure. The main cell 1 is pressurized using a inert gas such as Argon or Helium. The Argon gas region 17 is increased by the lower Argon gas region 29 which it connects to by the Argon gas line 36. This allows the main cell 1 to remain at approximately constant pressure during charging while the volume in the main cell 1 is changing. The total system Argon pressure can also be raised, by the vent 11, to allow more rapid charging rates.

The charging process uses the graphite electrodes 28 which are held by the electrode housing 3. The graphite electrodes 28 are set-up in series which allows an increase in the voltage used for input into the electrode feed lines 24, 25. The feed lines are isolated from the main cell 1 using ceramic insulation 47. This allows the current to be less for a given wattage input. The two electrode feed lines 24, 25 are connected to an outside direct current charging source. The electrode feed lines 24, 25 supply power to the end electrodes through the Molybdenum end plates 9,10 located outside of the two end electrodes. The Molybdenum end plates 9,10 are sealed from fluids to minimize corrosion and electrical leakage. The graphite electrodes 28 function by electrolysis of the salt which surrounds them. The current path is set-up to be the least resistance while passing through the graphite electrodes 28 series. This minimizes losses from electrolysis occurring outside of the graphite electrodes 28 stack. Each graphite electrode 28 is designed so that on one side of the graphite electrode 28, the Sodium metal is formed and released. The metal floats up into the electrically isolated Sodium region 6. The electrode housing 3 has a top 62 which has a well defined set of holes 64 to allow a controlled rate of liquid Sodium to float up through the salt mixture 15 as a series of small droplets; each droplet electrically separate from the rest. The Sodium passes through the insulator float plate 50 where it is wicked up through the dry Sodium Chloride region 8 to the sodium region 6.

The oxidizer is formed on the opposite face of a given graphite electrode 28 and is ducted inside of the graphite electrode 28 through the "valve electrode" 38. The oxidizer moves through a small electrode Chlorine outlet 39 located at the end of the graphite electrode 28 into the oxidizer outlet line 19. The oxidizer then travels through oxidizer recharge valve 21 and into the oxidizer tank 2. Upon entering the oxidizer tank 2, the oxidizer is cooled to ambient temperature conditions. The Chlorine mixes with the Iodine and Iodine Chloride to form Iodine TriChloride and Iodine Chloride. Both of these compounds are extremely stable and form a liquid in the oxidizer tank 2.

The electrode 28, in FIG. 3, has dense graphite 41 on five of the six sides. The 'valve electrode' side has a porous graphite 40. The ceramic coating 44 electrically insulates the electrode. The conductive coating 45, consisting of Chromium Carbide, increases the conductivity and wetting on the electrode face. The ceramic layer 43 provides the wetting surface for the 'valve electrode' to function.

The oxidizer side of the graphite electrode 28 functions using a 'valve electrode' technique. The 'valve electrode' 38 is designed to prevent the salt from migrating past the porous graphite 40 and ceramic layer 43 interface. This is accomplished using surface tension forces which allow a pressure differential between the main cell 1 and the oxidizer tank 2 without the salt moving across the barrier. The 'valve electrode' 38 works by having a porous, conducting, non-wetting medium located inside the electrode near the oxidizer face. Graphite is chosen for this material. A porous, nonconducting, wetting layer of material is covering the porous Graphite. The salt wets the nonconducting material and forms the interface where the electrolysis occurs for the oxidizer. The size of the maximum pressure differential which the interface can support is related to the viscosity of the salt and the pore size of the interface. A small pore size is beneficial for supporting larger pressures between the main cell 1 and the oxidizer tank 2.

A process was developed for producing the small pore size on the Graphite. The first step is to machine a porous electrode to the shape desired. The next step involves using a chemical vapor process which causes a ceramic compound to be form from the existing Graphite. Boron is chosen as a material for formation of the ceramic compound. The Boron forms Boron Carbide on the surface with nearly identical porosity as the initial Graphite surface. A final layer of Turbostratic Boron Nitride is vapor deposited over the Boron Carbide to further increase the electrical resistance of the ceramic layer 43.

The salt mixture 15 is chosen to be a low melting point salt mixture. Calcium Chloride and Barium Chloride are mixed with the Sodium Chloride to lower the melting point. The liquid salt is required for the electrodes to function. The two added salts were also chosen due their ability to remain compounds during the electrolysis so that only Sodium is formed.

As the Sodium Chloride is used up in the electrolysis reaction at the electrodes 28, the insulator float plate 50 slowly settles and allows dry Sodium Chloride powder to replace the Sodium Chloride which was separated out. The Sodium Chloride flows through holes in the Sodium Chloride holder plate 51. A path through the holder plate and float plate is formed when the float plate settles slightly. The insulator float plate 50 is shown constrained by limiters 72 to move only a small amount.

The electrolysis process can continue until all of the Sodium Chloride has been separated into its components. When the powdered Sodium Chloride region 8 is used up the quantity of Sodium Chloride in the salt mixture 15 will drop. The melting point of the salt mixture 15 will slowly rise as the Sodium Chloride is removed. The salt mixture 15 will then solidify around the electrodes 28 and stop the electrolysis from proceeding further. This offers a fail-safe technique in case the electrical circuit is not turned off. What should happen under normal operation is the current will drop and a charging circuit will detect the drop-off and stop the charging completely.

System Discharging

The main cell 1 can be stored almost indefinitely with the temperature of all the components at ambient conditions. For cell start-up, the salt mixture heater 48 is activated and allows heatup to 120 degrees Centigrade in the main cell 1. The heater conduit 23 holds the heater 48 and seals it from the rest of the cell. The ECT battery uses thermal discharge to obtain very high energy density and discharge rates. The ECT battery is designed for very rapid start-up once the Sodium is in the liquid state. The main cell 1 can be fully operational with the temperature in the main cell 1 above 120 Centigrade. The main cell 1 temperature and pressure are measured using the probes 55 and 56. The probes are located inside the vent and fill lines 11 and 16.

The oxidizer tank 2 is heated using the heater 22 to bring the oxidizer to a slightly higher pressure relative to the main cell pressure. The oxidizer temperature is measured using the probe 54. Once the system is up to temperature the oxidizer flow valve 20 can be used to control the heat output through the reaction chamber 30.

The use of a small reaction chamber allows faster start-up rates and provides a locally hotter reaction chamber 30 temperature which can be transferred to the external combustion engine for higher efficiency. The temperature in the reaction chamber 30 is monitored using the temperature probe 13. The probe can be tied to a feedback system with the oxidizer flow valve 20 so that the desired temperature in the reaction chamber 30 can be maintained. The Sodium enters the reaction chamber 30 using a wicking action in a Stainless mesh sodium wick 31 which runs from the liquid Sodium region 6 up inside the heat pipe 14. The wick holder 32 and the wick spacer 34 help hold the wick in position inside the reaction chamber 30.

The carbon spacer 35 is used to help insulate the reaction chamber 30 and to improve the heat transfer between the liquid salt and the incoming reactants. The reaction chamber 30 has a region, the Sodium inlet and Sodium Chloride outlet 33, where the liquid metal and oxidizer input line 18 are ducted past the outflowing salt. The salt is moving in the opposite direction as the metal and oxidizer and transfers the higher temperature heat from the salt into the metal and oxidizer preheating them prior to entering the reaction chamber 30.

The main cell 1 is surrounded by a multilayer foil evacuated region which minimizes the heat loss from the main cell 1. The connecting fittings to the main cell 1 are also insulated so that the main cell 1 can remain liquid for several days without operation. The evacuated coupling 4 reduces the losses at the fittings. If it is desired to maintain the main cell 1 at operating temperature then a small supply of oxidizer can be added to the oxidizer input line 18 using a temperature feedback system to monitor flow rates.

Description and Operation—Alternative Embodiments

The Electro-chemical-thermal cell can operate with a wide number of variations in its components. The only features which are specific to the cell are:

1. The use of electricity and/or thermal energy to reverse the process and effectively recharge the ECT cell.
2. The storage of energy mainly in the form of a chemical change. A combination of chemical and thermal storage is also available.
3. The output is mainly thermal. Electrical output could be produced by wicking the liquid metal down to, each/or some, of the electrode faces. The output could then allow combinations of thermal and electrical energy such as thermal only, thermal and electrical, or electrical only.

Main Cell 1

The general arrangement can vary considerably over what is currently shown in FIG. 1:

It is possible to have the liquid metal heavier than the salt in which case the electrodes would be on top; also the liquid metal feed line would be reversed and connected to the lower metal region.

It would be possible to store the liquid metal in a separate container. The metal could be wicked into individual containers; one for each electrode.

It would also be possible to move the reaction chamber out of the main cell. Feed lines to the reaction chamber would be required and a salt drain to move the salt to the main cell once the metal and oxidizer have reacted.

It may be possible to use a metal and oxidizer which can both be stored in the main cell. For instance if both, metal and oxidizer, were liquids at the operating temperatures then one could be heavier and one could be lighter than the salt. This would allow the salt to keep the two reactants apart. With this system, the separate oxidizer tank 2 would not be required.

It may be possible to use preferential wicking regions to separate the salt and liquid metal. By wicking the liquid metal away from the electrodes in may be possible to make the main cell orientation independent or even gravity independent; i.e. zero gravity.

The main cell could also be put in some type of cradle arrangement where it would orient itself with gravity and the outer container could move independently.

The main cell could be made into any shape required. For instance, it could be taller or wider in any direction. It could also be tapered in any direction to meet requirements.

Another arrangement of the main cell is to spin the cell about an axis. Centrifugal force could be used to separate components.

The main cell and/or oxidizer tank could be made of Carbon/Carbon or Boron Nitride/Boron Nitride. The ceramic liner, in the main cell, could be any individual layer or combination layers of Boron carbide, Cubic Boron Nitride, Turbostratic Boron Nitride, Chromium Carbide, and Hexagonal Boron Nitride.

Oxidizer Tank 2

The tank can be changed in size and shape to meet requirements. For instance, it can be round or cylindrical with flat or rounded ends. The tank can be made of a variety of material, including metals, ceramics, composites. Liners or coatings can also be applied to the tank to prevent corrosion; multiple layers or single layers can be used. The oxidizer tank can be placed in any orientation relative to the main cell. It can be above, below or next to the main cell.

The use of a binary, or higher multiple, oxidizer for the ECT system is unique, i.e. Iodine and Chlorine. Using two components which combine to form a third compound allows an improvement in system safety and can ease storage. For instance, two substances combining to create a liquid or solid stores at lower pressure and with possibly a smaller tank size. Other oxidizers which could be considered include: 1. Fluorine and Chlorine, 2. Fluorine and Iodine, 3. Fluorine and Bromine, 4. Fluorine and Sulphur, 5. Chlorine and Sulphur, 6. Chlorine and Bromine, 7. Fluorine and Oxygen, 8. Hydrogen and Chlorine, 9. Hydrogen and Fluorine, 10. Phosphorus and Chlorine, 11. Phosphorus and Bromine, 12. Phosphorus and Fluorine, 13. Arsenic and Chlorine, 14. Arsenic and Bromine, 15. Chlorine and Iodine, or 16. Tin and Chlorine. Single oxidizer substances could include: Sulphur, Selenium, Tellurium, Tin, Arsenic, Antimony, Chlorine, Fluorine, Iodine or Bromine.

Electrode Housing 3

The electrode housing consists of a box for holding the electrodes and conduits for bringing the oxidizer and electrode feed lines out of the main cell. The oxidizer outlet line 19 can be attached to any part of the electrode housing and can project through the main cell in any orientation.

The electrode housing can be curved or fabricated in any shape as long as it serves to hold the electrodes. Multiple housings could be used with batches of electrodes.

The oxidizer outlet line 19 can be used for charging where the oxidizer flows away from the electrodes or it can used for discharging, producing electricity where the oxidizer flows toward the electrodes.

The electrode housing could be eliminated if the electrodes were mounted directly in the main cell with electrode end holders mounted on the main cell walls. Spacers could also be used to hold the electrodes in place inside of the main cell. The end electrodes could be mounted directly in the main cell wall. This could keep the electrode feed lines 24, 25 completely outside of the main cell. The electrode feed lines 24, 25 could be made retractable and touch the electrode end plates only when required for charging. This would reduce the thermal conduction path. One possibility is to have the electrode feed lines 24, 25 change shape from heating to a certain temperature, or from an external electrical input. The use of a bimetallic strip, for the electrode feed lines 24, 25, could expand differentially with temperature and touch only at the charging temperature.

The oxidizer outlets 39 could be designed to pass though the main cell wall and connect with a common oxidizer outlet or mixing chamber on the main cell outer wall.

The oxidizer lines 18, 19, could be combined into a single line. Temperature sensitive or 1 way valves could be used to direct the flow inside of the main cell. For instance, the oxidizer flow could be designed to only flow away from the electrodes when the main cell pressure is higher than the oxidizer tank. If the main cell is hotter for charging, possibly to melt the salt, then a thermal expansion type valve could be used to block flow to the reaction chamber 30. For start-up, an automatic expansion type valve could be closed in the oxidizer input line 18 when the main cell temperature is too low and open once it reached a certain temperature.

A cooling system could be required for system operation to maintain a given temperature. Cooling lines could be put into the main cell 1.

A system similar to the bimetal power bus could be used for cooling. If the temperature exceeded a certain amount the metal strip would touch the outside of the main cell 1 and significantly increase the heat transfer rate through the metal strip.

The electrode housing 3 could be fabricated from a number of materials. Different types of conducting and/or nonconducting fibers could be used. Metal conduits could be used for the oxidizer if corrosion did not occur. Combinations of metal and ceramic could be used to minimize heat loss. The baseline design uses a metal structure but a carbon/carbon or Boron Nitride/Boron Nitride structure which is coated with a nonconducting and nonwetting layer could also be used. Hexagonal Boron Nitride can serve as the coating. Additions of Boron Carbide and Cubic Boron Nitride, as base layers, may add to the life of the coating.

Evacuated Coupling 4

The main cell system could be designed with or without any of the couplings. The couplings could have multiple layers of foil inside to aid heat loss. The couplings could be any shape or size.

Main Cell Outer Container 5

The container serves to keep the working fluids inside at operating conditions with minimal losses. The baseline design is to use a Stainless Steel container. The container can be made from any fiber or metal or combination of both.

Fittings or openings are used to access the various hardware that go in and out of the main cell.

The container can be any shape or size depending on requirements.

Sodium Region 6

The metal region can contain a porous felt or wicking material to keep the metal from splashing. Boron Nitride or carbon fibers would work for this purpose.

All metals and metal combinations could be used, for the system, as fuel. Some of these would include: Sodium, Calcium, Lithium, and Magnesium.

Main Cell Inner Container 7

The inner walls are pressure formed into a mold after heating to forming temperature. The container can be any shape to accommodate the battery requirements. The container can be metal or a combination of fibers and binders.

Sodium Chloride Region 8

A porous felt material could be used to prevent sloshing. Boron nitride or carbon felt could be used for this purpose.

Molybdenum End Plates 9, 10

The end plates serve to spread the electrical current uniformly across the end electrodes. Other materials could be used besides the Molybdenum such as certain Stainless steels or conductive ceramics; such as Chromium Carbide. The end plate could be placed against the main cell container wall with a single electrode feed line 24, 25 going through the wall on each end. Sealing would be required where the electrode feed line 24, 25 goes through the main cell wall.

The end plates could be eliminated by using the electrode feed line 24, 25 directly against the end electrodes. The electrode feed line 24, 25 could be flattened to improve contact to the electrodes.

Vent and Pressure Probe Holder 11

This probe is for monitoring cell performance. The probe could be tied into the control system or they could be removed once the complete system is operational.

Heat Pipe 14

The heat pipe is sized based on the heat flow rate requirements. Other forms of heat transfer systems could be used including boilers and metallic conductors. Single or multiple pipes can be bundled together to form the heat transfer mechanism.

The heat pipe could be any shape or size. The current configuration shows a hollow tubular shape. A variation would have a central tube shape which is located inside the reaction chamber and which protrudes down from the top. The wick could be attached to this center region.

The heat pipe could enter the main cell 1 at any location.

The heat pipe could be welded or attached directly into the main cell 1.

Salt Mixture 15

A number of salt combinations could be used for this region. The salts planned for use allow the Sodium Chloride to electrolyze first. Partial combinations of salt reactions could be beneficial. A single salt could also be used. Other types of mediums would work if they allowed a reduced temperature for electrolysis relative to the pure salt.

Fill Line and Temperature Holder 16

The line could be made from Stainless Steel or other non reactive materials.

Argon Gas Region 17

The region can vary in size depending on quantities of salt and metal. The use of an inert gas with a low boiling point is ideal. Various gases could be used to equalize the pressure between the two containers. Argon, Nitrogen, or Helium should also work but the pressure is going to vary with the level of fluids and the initial charge pressure.

Oxidizer Input Line 18

Hastaloy C should work for this pipe up to the reaction chamber. Other types of metallic alloys or alloy with internal coatings could be used. Chromium Carbide could be added to the metal surface. A carbon or graphite pipe should be used for the high temperature area. Hexagonal or Cubic Boron Nitride could be used as a sealer. Various Molybdenum alloys could also be used. Various Stainless alloys could also be used.

Oxidizer Outlet Line 19

The line is sized for maximum flow requirements for charging. Chromium Carbide and/or Hexagonal or Cubic Boron Nitride would work as a sealer. The line could be carbon or a Stainless material such as Hastaloy C or Molybdenum alloys.

Oxidizer Flow Valve 20

The valve controls the oxidizer output for discharging. The valve can be manual or automated. It can be tied directly to temperature probe 13 for oxidizer flow rates. The valve can be Hastaloy C, Stainless Steel, or Carbon. Coatings with Hexagonal Boron Nitride can be used as a sealer. Varying types of Teflon coatings could also be used.

Oxidizer Recharge Valve 21

This valve is set to prevent the pressure between the two tanks from exceeding a specified value. It also controls whether the oxidizer is moving in or out of the main cell. The valve can be Hastaloy C or Carbon. Coatings with Hexagonal Boron Nitride or Teflon can be used as a sealer. Other types of metal and/or ceramics can be used for the valve.

Heater for Oxidizer Region 22

This heater controls the temperature and pressure of the oxidizer tank. Heating will be required for output and cooling required for charging. The pipe can be heated by the heat pipes from the reaction chamber.

A closed water loop can also be used for heating and cooling.

Electrical heating of the oxidizer tank with water cooling could be used.

Electrode Feed Lines 24, 25

The power rods can be made of any electrically conducting material. Molybdenum matches expansion with carbon. The rods are sized for maximum current flow on charging. The rods are sealed inside of the main cell to prevent corrosion and shorting to the main cell walls. Combinations of ceramic, Turbostratic, or Hexagonal Boron Nitride provide seals.

Thermal Cover 26

Insulation around the oxidizer tank can be from a number of materials such as rigid or blanket silica insulation or an evacuated region. Leaving the insulation off may be possible based on flow rates.

Evacuated Region 27

Thermal cover for the main cell could be rigid or blanket silica insulation. A multilayer reflective foil evacuated container is preferred for size and insulating benefits. Extended evacuated tubes may be used surrounding fittings. Single layer evacuated containers could also be used.

Graphite Electrodes 28

The number of electrodes is based on charging voltage requirements and type of salt used. Electrodes can be flat or have faces which are shaped to maximize area. Shaping can also be used to maintain a uniform electrical field on the electrode face. The spacing between electrodes can vary depending on salts used and metal contamination to adjacent electrode. The shape and size will vary depending on requirements.

Reaction Chamber 30

The reaction chamber is formed from 430 Stainless Steel. Carbon/Carbon can also be used or Molybdenum alloys. The chamber can be rounded in any direction. The various heat pipes, inlets and drains can enter or leave the chamber from any side. Coatings can be applied such as Cubic Boron Nitride, turbostratic Boron Nitride, Hexagonal Boron Nitride, Chromium Carbide, and Boron Carbide. Combinations of these coatings can also be applied. A coating of Lithium Carbide can be used to protect the inner surface of the reaction chamber.

Wick Holder 32

The holder could be any shape or size. The holder could be used to support various spots inside the reaction chamber.

Sodium Inlet and Sodium Chloride Outlet 33

The opening can be located anywhere on the reaction chamber. The opening can be any number of sizes and quantity. The design is used to act as a heat exchanger between the outgoing hot fluids and the incoming cooler fluids.

Ceramic Spacers 37

The spacers can be machined as separate pieces such as graphite or hexagonal Boron Nitride. If graphite is used the spacers should be coated with hexagonal Boron Nitride or a combination of boron ceramics including cubic Boron Nitride and Boron Carbide. The spacers could also be made from rigid silica board and coated with hexagonal Boron Nitride.

The spacers could be machined directly on the electrode housing 3. Ceramic coatings could be applied when the electrode housing 3 is coated with ceramics.

The spacers could be machined onto a separate rail. The rail could fit directly into the main cell 1. The rail and spacers could use any combination of ceramic coatings including: Boron Carbide, hexagonal Boron Nitride, or cubic Boron Nitride.

Valve Electrode 38

The valve electrode can be made from any combination of a conducting and nonwetting substrate, relative to the salt, and a wetting and nonconducting outer layer. The baseline uses porous graphite as the substrate or inner layer. The coating can consist of combinations or individual layers of Boron Carbide, Cubic Boron Nitride, Magnesium Oxide, or Beryllium Oxide.

Oxidizer Outlet 39

The outlet can be machined or manufactured as a separate piece or it can be made directly from the dense graphite 41 piece. Carbon/carbon tubing of any shape could be used. A machined piece of hexagonal Boron Nitride could also be used; with any desired shape. If a conducting material is used then an insulator, such as Boron Nitride is needed over the surface to prevent shorting to the electrode housing.

Porous Graphite 40

The graphite can have any number of variations in porosity and pore size distribution. Any conductive porous material which is compatible with the oxidizer could be used for this application.

The basal plane in the graphite should be aligned with the current direction to minimize resistance.

A conductive paste could be applied between the graphite 40 and the dense graphite 41.

The porous graphite could be used for the whole electrode with coatings on various faces to prevent leakage. The oxidizer slots could be made by drilling at varying angles throughout the oxidizer outlet 39.

If the oxidizer is kept inside the main cell then a nonporous conductive material could be used.

Dense Graphite 41

The dense graphite is used to keep the oxidizer from flowing though its surface. The graphite could be machined or made from a carbon/carbon piece which is baked to convert the material to graphite.

Slotted Cavity 42

The cavity can be made from any type of material which is not affected by the oxidizer. The cavity could be machined directly into the dense graphite 41. The cavity could be machined from the porous graphite 40. The cavity could be made from a metal such as a Stainless alloy.

The cavity should be made with an even distribution of channels to duct the oxidizer from the porous graphite 40 to the oxidizer outlet 39. This distribution helps to maintain a uniform electric field through the electrode. If a prescribed electric field is beneficial, such as one which is located mainly in the center of the electrode, then the cavity could be machined around the inner rim of the electrode 28.

Ceramic Layer 43

This layer is described in the section on the 'valve electrode' for an internally ducted oxidizer. If the oxidizer is kept inside of the main cell 1 then the surface layer would be conducting and wetting similar to the conductive coating 45. An oxidizer that could work for this could include Sulphur, Selenium, Arsenic, Antimony, Tin, or Tellurium which would sink in the main cell 1 after electrolysis. The salt would be used to separate the liquid metal and the oxidizer. For this arrangement, the electrodes 28 would help keep the metal and oxidizer apart.

Ceramic Coating 44

This coating is a nonwetting and nonconducting layer of ceramic. The material could use any combination of ceramic coatings including, but not limited to: Boron Carbide, hexagonal Boron Nitride, or cubic Boron Nitride.

Conductive Coating 45

This coating provides a wetting and conducting layer for the electrode 28. Materials for this could include: Chromium Carbide or Titanium Carbide or other types of metallic carbides.

The coating could also be a Stainless Steel or Molybdenum material which is applied directly to the electrode 28 or pressed onto the surface as a porous gauze of mesh.

Insulator Float Plate 50

This plate is made from a nonconducting material which floats on the salt mixture layer. It should be heavier than the liquid metal with small holes across the surface to allow the Sodium to pass through. The hole pattern should also prevent the dry Sodium Chloride from moving into the region of the salt mixture 15 when the plate is near the sodium chloride holder plate 51.

Sodium Chloride Holder Plate 51

The plate can be fabricated from a metal or fiber material. The hole pattern is variable depending on design and salt flow rate requirements. The plate is anchored to either the main cell wall or the electrode housing.

General Modifications

Other ceramic materials could be used instead of the Boron ceramics. The compatability of the metal and oxidizer could be used to determine which ceramic is appropriate.

Other metals or conducting or nonconducting ceramics, used as appropriate, could replace the carbon or graphite if they were compatible with the metal or oxidizer used.

Other metals or conducting ceramics can be used to replace the Molybdenum parts.

If the system is used as a heater where focusing the heat was not required, then the following parts could be eliminated: 14, 30, 31, 32, 33, and the coupling extension at the eat pipe region.

While the above description contains may specificities, these should not be construed as limitations on the scope of the invention, but rather as an exemplification of one preferred embodiment thereof. Many other variations are possible.

The electro-chemical-thermal cell represents a unique combination of electrical and thermal systems. The combination provides 10 fold increases in both power and energy densities relative to the best electrical battery system. This makes this cell ideal as an energy storage and delivery system for vehicles.

The individual elements can be used as a whole unit or as sub-assemblies on new or existing battery designs.

Accordingly, the scope of the invention should be determined not by the embodiments illustrated, but by the appended claims and their legal equivalents.

What is claimed is:

1. A method of converting and storing energy in a repeatable cycle comprising the steps of:

(a) electrolyzing a reactant product into separate reactants;

(b) storing the reactants; and (c) controllably combining the reactants to produce a heat output and restore the reactant product.

2. The method of claim 1, wherein step (a) includes the substep of:

driving one of the reactants through a porous portion of an electrode as the reactant is produced.

3. The method of claim 2, wherein the reactant is driven into an internal cavity in the electrode.

4. The method of claim 1, wherein step (b) includes the substep of:

moving the separate reactants into separate storage compartments; and wherein step (c) includes the substep of moving the reactants into a reaction chamber in which the reactants are combined.

5. The method of claim 4, wherein one of the reactants is moved into the reaction chamber by wicking action between a storage compartment and the reaction chamber.

6. The method of claim 4, wherein one of the reactants is moved to the reaction chamber by flowing through a tubular line having a valve to regulate the flow of the reactant.

7. The method of claim 1, wherein one of the reactants is an oxidizer, and step (b) includes the substep of storing the oxidizer in iodine.

8. A method of using a rechargeable energy cell having a container holding chemical reactants and reactant product, at least one electrode in operational communication with the reactant product, a portion of the electrode being porous, electrical connections in electrical communication with the at least one electrode, and a thermal output region connected to the container, comprising the steps of:

(a) electrically energizing the electrical connections to electrolyze the reactant product into the reactants;

(b) conveying one of the reactants through the porous portion of the electrode without conveying the reactant product through it;

(c) storing the reactants separately; and (d) de-energizing the electrical connections;

(e) controllably combining the stored reactants to produce the reactant product and thermal energy in the thermal output region; and (f) removing the thermal energy from the thermal output region.

9. A method of electrically charging and thermally discharging an electrolytic energy cell comprising the steps of:

(a) electrically energizing electrolysis electrodes in the cell to thereby electrolyze a reactant product into constituent reactants;

(b) moving the reactants into separate storage compartments;

(c) de-energizing the electrodes;

(d) controllably combining the stored reactants to produce the reactant product and heat; and (e) removing the heat from the cell for useful purpose; wherein the cell is charged electrically and discharged thermally.

10. The method of claim 9, wherein step (a) includes the substep of:

driving one of the reactants through a porous portion of an electrode as the reactant is produced.

11. The method of claim 10, wherein the reactant is driven into an internal cavity in the electrode.

12. The method of claim 10, further comprising the steps of:

collecting the reactant driven through the porous portion of the electrode; and moving the collected reactant away from the electrode.

13. The method of claim 11, wherein step (b) includes the substep of:

moving the reactant out of the cavity.

* * * * *